US005557371A

United States Patent [19]

Tooda

[11] Patent Number: 5,557,371

[45] Date of Patent: Sep. 17, 1996

[54] ELECTROPHOTOGRAPHIC APPARATUS

[75] Inventor: Toshio Tooda, Kanagawa, Japan

[73] Assignee: Fujitsu Limited, Kawasaki, Japan

[21] Appl. No.: 401,137

[22] Filed: Mar. 8, 1995

[30] Foreign Application Priority Data

Jun. 2, 1994 [JP] Japan ..... 6-121053

[51] Int. Cl.[6] ..... G03G 5/00; G03G 15/04; G03G 15/056

[52] U.S. Cl. ..... 355/211; 347/140; 355/251

[58] Field of Search ..... 355/210, 211, 355/251, 261, 253, 269, 271, 270, 219; 118/657, 658, 644, 652, 657, 661; 347/140

[56] References Cited

U.S. PATENT DOCUMENTS

| | | | |
|---|---|---|---|
| 3,924,945 | 12/1975 | Weigl | 355/271 X |
| 5,159,389 | 10/1992 | Minami et al. | 355/211 |
| 5,424,811 | 6/1995 | Haneda | 355/251 |
| 5,432,033 | 7/1995 | Asanae et al. | 355/219 X |

FOREIGN PATENT DOCUMENTS

| | | |
|---|---|---|
| 60-22145 | 2/1985 | Japan . |
| 61-46961 | 3/1986 | Japan . |

*Primary Examiner*—Arthur T. Grimley
*Assistant Examiner*—Shuk Y. Lee
*Attorney, Agent, or Firm*—Nikaido, Marmelstein, Murray & Oram LLP

[57] ABSTRACT

An electrophotographic apparatus has a plurality of developing rollers arranged in a row in the direction of rotation of a photosensitive member so as to face the surface of the photosensitive member. Each developing roller retains on the surface thereof a developer consisting essentially of an electrically insulating magnetic toner and an electrically conductive magnetic carrier. At least the surface portion of each developing roller is driven to rotate in order to transport the developer to the surface of the photosensitive member. A developing bias voltage is applied to each of the developing rollers. Exposure is carried out by applying image light from the reverse side of the photosensitive member toward the most downstream developing roller as viewed in the direction of rotation of the photosensitive member.

10 Claims, 9 Drawing Sheets

ELECTROPHOTOGRAPHIC APPARATUS

BACKGROUND OF THE INVENTION

1. Field of the Invention

The present invention relates to an electrophotographic apparatus which employs a novel process in which charging, exposure and development are almost simultaneously carried out with respect to a photosensitive member at one position.

2. Description of the Related Art

There are widely used electrophotographic apparatuses which utilize the Carlson process, in which a charging device, an exposure device, a developing device, etc. are disposed in order around a photosensitive member.

However, there has recently been developed an electrophotographic apparatus which uses a novel process in which exposure is carried out for a photosensitive member from the inside thereof, and in which charging, exposure and development are carried out almost simultaneously at one position, thereby achieving reduction in size of the apparatus.

FIG. 9 shows an electrophotographic apparatus which uses such a novel process. The electrophotographic apparatus has a photosensitive drum 90 which is formed by successively stacking a transparent conductive layer 92 and a photoconductive layer 93 on the outer surface of a transparent cylinder 91.

Further, a developing roller 95 is disposed to face the outer surface of the photosensitive drum 90, and an exposure device 94 for image exposure is disposed inside the photosensitive drum 90 so as to face toward the developing roller 95.

The electrophotographic apparatus uses a developer 96 which is a two-component developer formed by mixing together electrically insulating magnetic toner and a magnetic carrier of low electric resistance. The developing roller 95 has a structure in which a conductive sleeve is driven to rotate around a fixed magnet roller. A developing bias voltage source 97 applies a developing bias voltage of −400 V, for example, to the developing roller 95.

In the above-described apparatus, all the processes for the photosensitive drum 90, i.e., charging, exposure, development and cleaning of residual toner, are carried out in an area (developing nip) where the developer 96 on the developing roller 95 is in contact with the photosensitive drum 90.

First, charging is carried out as follows: The developing bias voltage that is applied to the developing roller 95 is transmitted to the photosensitive drum 90 through the conductive carrier mixed in the developer 96, thereby charging the photoconductive layer 93 provided over the surface of the photosensitive drum 90.

Image exposure that is carried out by the exposure device 94 is effected with respect to the developing nip portion. Thus, the voltage at the surface of the photosensitive drum 90 becomes close to zero (e.g., −20 V) only at the exposed portion, thereby allowing an electrostatic latent image to be formed.

While the exposed portion is passing through the developing nip, the toner is strongly attracted to the exposed portion from the developing roller side by electrostatic force. Thus, the electrostatic latent image is developed by the toner.

While passing through the developing nip, the portion of the photosensitive drum 90 other than the exposed portion is charged to a voltage close to the developing bias voltage applied to the developing roller 95, e.g., about −380 V.

Accordingly, at the non-exposed portion of the photosensitive drum 90, the magnetic force with which the magnet roller of the developing roller 95 attracts the toner, which is magnetic powder, is stronger than the electrostatic force with which the photosensitive drum 90 attracts the toner. Therefore, no toner adheres to the non-exposed portion. As a result, the toner is attached to only the exposed portion of the photosensitive drum 90, and thus a toner image corresponding to the exposure image is formed.

FIG. 10 is a diagram showing the relationship between the voltage at the exposed portion and the voltage at the surrounding non-exposed portion in a typical Carlson process. FIG. 11 is a diagram showing the relationship between the voltage at the exposed portion and the voltage at the surrounding non-exposed portion in the above-described novel process.

In the Carlson process, as shown in FIG. 10, the photosensitive drum charging voltage (i.e., the voltage at the non-exposed portion) V0 and the developing bias voltage Vb applied to the developing roller are set independently of each other. For example, the voltage V0 at the non-exposed portion is set to −600 V, and the developing bias voltage Vb is set to −400 V. The voltage V1 at the exposed portion is, for example, −20 V.

Accordingly, in the Carlson process, the toner in the non-exposed portion is surely attracted to the developing roller by electrostatic force. Therefore, the "smudge" phenomenon that toner undesirably adheres to the non-exposed portion of the photosensitive drum, to which toner must not be attached, is unlikely to occur.

In the novel process, as shown in FIG. 11, the photosensitive drum charging voltage (i.e., the voltage at the non-exposed portion) V0 and the developing bias voltage Vb cannot be set independently of each other. Accordingly, even at the non-exposed portion, electrostatic force acts on the toner so that the toner is attracted to the photosensitive drum 90.

However, since the charging voltage V0 is very close to the developing bias voltage Vb and thus electrostatic force acting on the toner in the non-exposed portion is extremely small, as described above, the toner is pulled away from the non-exposed portion and collected to the developing roller side by magnetic force that has been set so as to be stronger than the electrostatic force.

In the novel process, however, the electric resistance of the carrier gradually increases as printing is continued for the reasons that foreign matter may adhere to the carrier, and that carbon may fall off from the carrier due to stirring, and further that small carrier particles may slip off.

As the electric resistance of the carrier increases, the charging voltage of the photosensitive drum 90 lowers because the photosensitive drum 90 cannot sufficiently be charged through the carrier. Accordingly, in the non-exposed portion, electrostatic force that attracts the toner to the photosensitive drum 90 increases, causing "smudge" to occur. As a result, it becomes necessary to exchange the whole developer for a new one. Thus, the lifetime of the developer is disadvantageously shortened.

SUMMARY OF THE INVENTION

An object of the present invention is to provide an electrophotographic apparatus that uses a novel process in which charging, exposure and development are almost simultaneously carried out with respect to a photosensitive member at one position, which is designed so that it is possible to prevent occurrence of "smudge" for a long period of time and to enable the developer to have a long lifetime.

Other objects and advantages of the present invention will become apparent from the following detailed description of illustrated embodiments of the invention.

According to the present invention, there is provided an electrophotographic apparatus which includes a photosensitive member having a transparent conductive layer which is optically transparent or semitransparent and of high electric conductivity, and a photoconductive layer which is stacked on the surface of the transparent conductive layer. The photosensitive member is driven to rotate. A plurality of developing rollers are arranged in a row in the direction of rotation of the photosensitive member so as to face the surface of the photosensitive member. Each developing roller retains on the surface thereof a developer consisting essentially of an electrically insulating magnetic toner and an electrically conductive magnetic carrier. At least the surface portion of each developing roller is driven to rotate in order to transport the developer to the surface of the photoconductive layer of the photosensitive member. The electrophotographic apparatus further includes a device for applying a developing bias voltage to each of the developing rollers, and a device for exposing the photosensitive member by applying image light from the reverse side of the photosensitive member toward one of the developing rollers which is disposed most downstream in the direction of rotation of the photosensitive member.

BRIEF DESCRIPTION OF THE DRAWINGS

The present invention may be more fully understood from the description of preferred embodiments of the invention set forth below, together with the accompanying drawings, in which.

DESCRIPTION OF THE PREFERRED EMBODIMENTS

Embodiments of the present invention will be described below with reference to the accompanying drawings.

Figure 1:
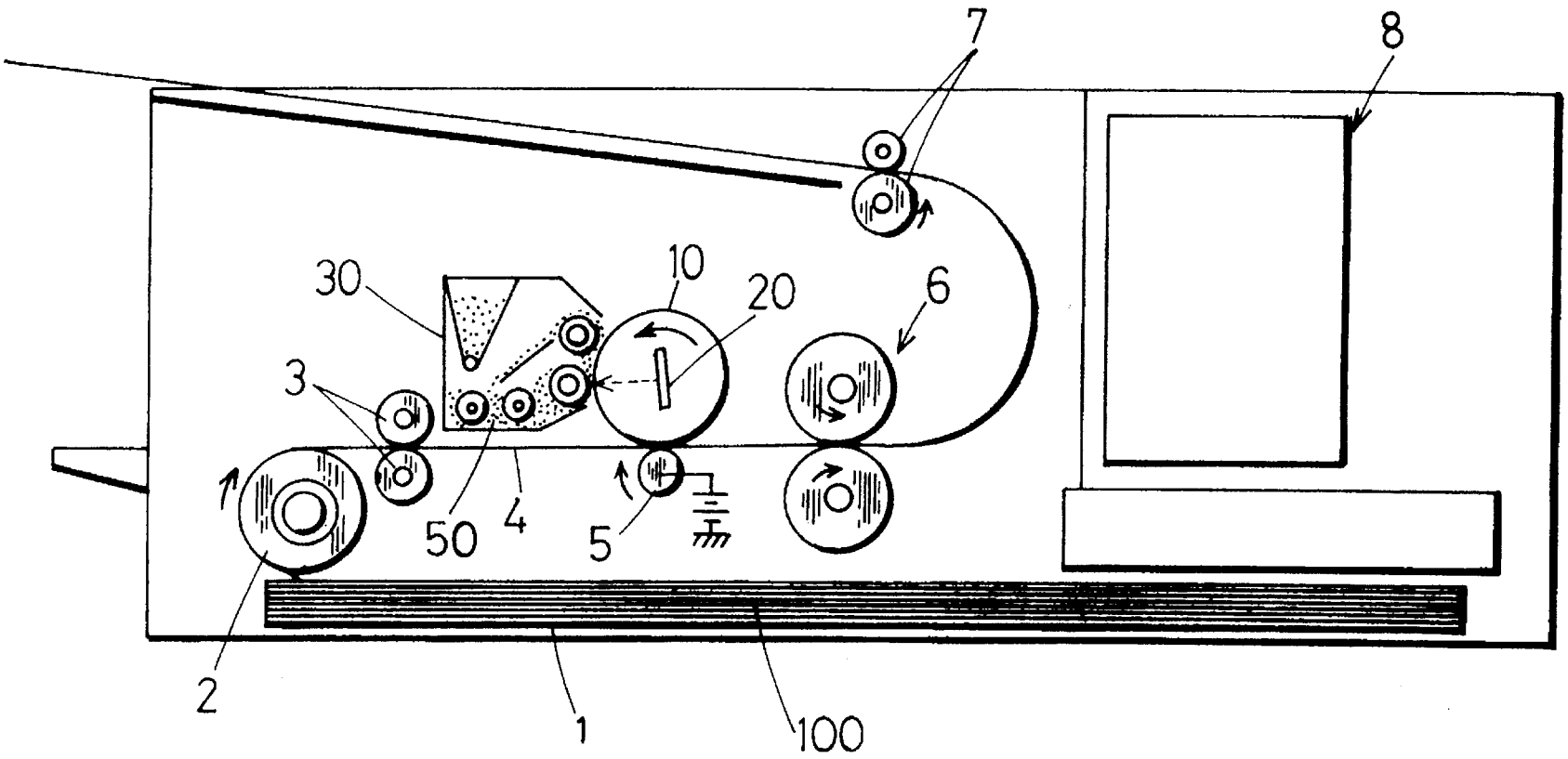
FIG. 1 is a sectional side view showing the general arrangement of a first embodiment of the present invention.

FIG. 1 shows an electrophotographic apparatus to which the present invention is applied. Recording paper 100 is delivered from a paper cassette 1 by the action of a pickup roller 2 and fed to a paper transport path 4 through a pair of resist rollers 3 which control the transport timing.

As the recording paper 100 passes between a photosensitive drum 10 and a transfer roller 5, a toner image formed on the surface of the photosensitive drum 10 is transferred to the recording paper 100. To transfer the toner image, a plus transfer voltage is applied to the transfer roller 5. Subsequently, the recording paper 100 passes through a fixing device 6, thereby allowing the toner image to be fixed to the recording paper 100. Then, the recording paper 100 is discharged to the outside of the apparatus by the action of a pair of delivery rollers 7.

The photosensitive drum 10 is a cylindrical member which is driven to rotate in the same direction as the transport direction of the recording paper 100. An exposure device 20 for exposing the photosensitive drum 10 by irradiation with image light is disposed inside the photosensitive drum 10. The exposure device 20 is secured to a frame of the electrophotographic apparatus. A developing device 30 contains a developer 50 for developing an image on the surface of the photosensitive drum 10. The electrophotographic apparatus further has a power control circuit 8.

Figure 2:
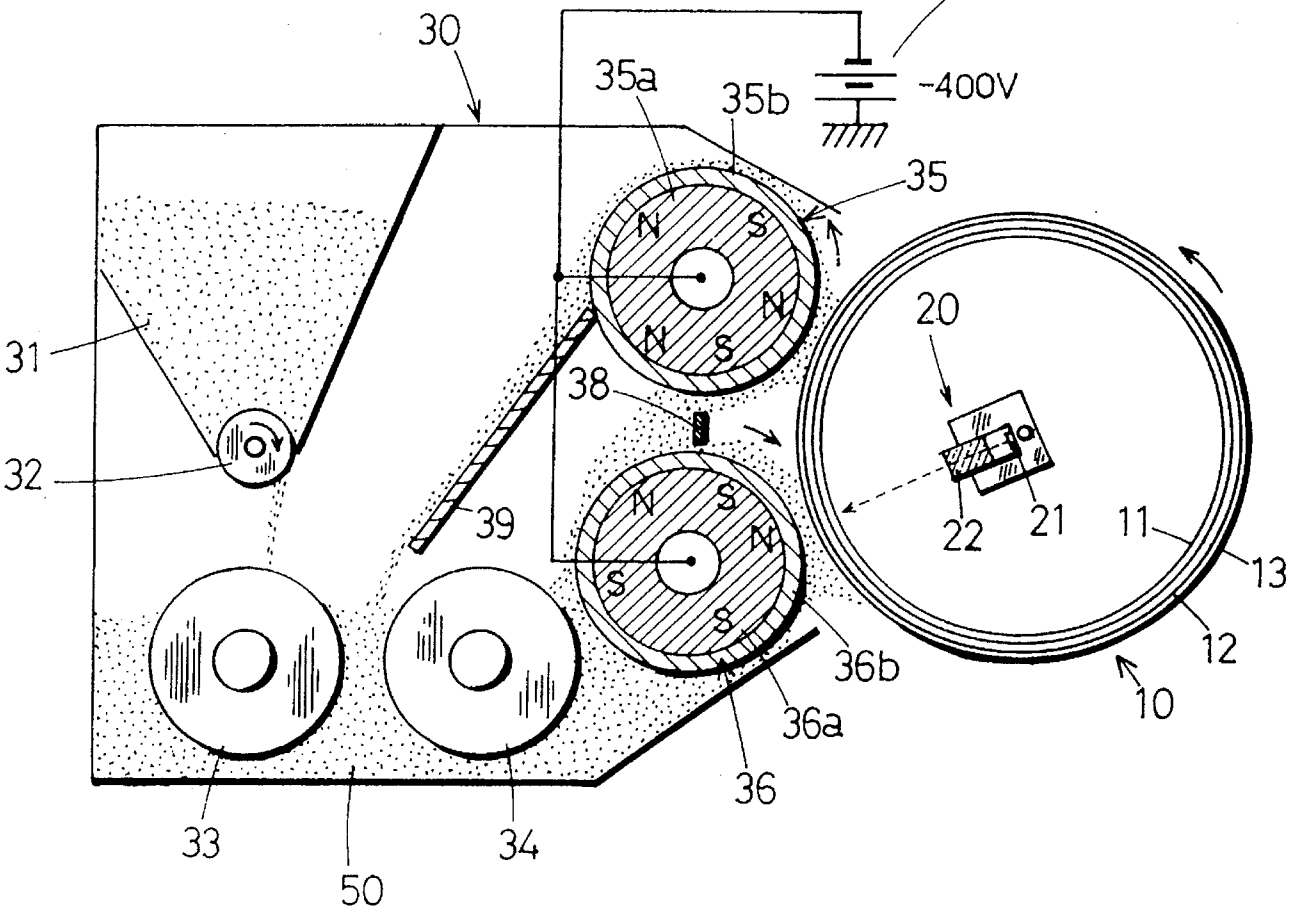
FIG. 2 is a sectional side view showing the arrangement of an essential part of the first embodiment.

FIG. 2 shows an essential part of the electrophotographic apparatus which includes the photosensitive drum 10 and the developing device 30. The photosensitive drum 10 is formed as follows: A transparent conductive layer 12 which is optically transparent or semitransparent and of high electric conductivity, e.g., a deposited ITO (indium tin oxide) film is evaporated onto the outer surface of a transparent cylinder 11 of glass or other similar material, and a photoconductive layer 13 is stacked on the outer surface of the transparent conductive layer 12. Examples of materials usable for the photoconductive layer 13 are an organic photoconductor, α-Si, and selenium.

As a light source for the exposure device 20, an LED array 21 is used in which a large number of light-emitting diodes (LEDs) are arrayed in the axial direction of the photosensitive drum 10. The developing device 30 has a plurality of developing rollers 35 and 36 arranged in a row in the direction of rotation of the photosensitive drum 10. The exposure device 20 is disposed to face the developing roller 36 which is disposed most downstream in the rotational direction of the photosensitive drum 10.

Image light which is emitted from the LED array 21 under the control of a controller (not shown) is passed through a rod lens 22 to form an image on the photoconductive layer 13. In this way, the photoconductive layer 13 is exposed to the image light from the reverse side of the photosensitive drum 10.

The developing device 30 accommodates a two-component developer 50 which is a mixture of electrically insulating and magnetic toner and a medium-resistance magnetic carrier having an electric resistance in the range of from $10^6$ to $10^8$ ohm-cm.

It should be noted that any medium-resistance carrier having an electric resistance in the range of from $10^4$ to $10^{10}$ ohm-cm shows a much weaker tendency to increase in resistance during use than a low-resistance carrier and therefore enables the developer to have a long lifetime.

However, since toner alone is consumed in development, a toner hopper 31 which stores toner is provided in the upper half of the developing device 30. The toner stored in the toner hopper 31 is allowed to drop into the developing device 30 little by little by rotation of a toner feed roller 32 which is provided at the lower end of the toner hopper 31. In this way, the toner stored in the toner hopper 31 is fed into the developing device 30.

The developer 50 is stirred by stirring rollers 33 and 34 which are driven to rotate in the vicinity of the bottom of the developing device 30, thereby allowing the toner and carrier in the developing device 30 to be uniformly mixed together.

Two developing rollers 35 and 36 are disposed in an opening which is provided in a side of the developing device 30 such that the developing rollers 35 and 36 face opposite to the photosensitive drum 10 and extend parallel to it. The two developing rollers 35 and 36 have the same size and are disposed on the same circumference which is centered at the central axis of the photosensitive drum 10.

Accordingly, the gaps between the two developing rollers 35 and 36 and the surface of the photosensitive drum 10 are equal to each other. For example, the gap is set in the range of from 0.1 mm to 1 mm so that the most favorable developing nip is formed.

The developing rollers 35 and 36 are respectively formed from non-rotatable magnet rods 35*a* and 36*a*, each having a plurality of magnetic poles formed in the circumferential direction, and sleeves 35*b* and 36*b* which are made of a good electrical conductor, e.g., aluminum, and which are fitted on the respective peripheries of the magnet rods 35*a* and 36*a* so as to rotate around them.

In this embodiment, the upstream-side developing roller 35, which is disposed upstream in the rotational direction of the photosensitive drum 10, is driven to rotate in the same direction as the rotational direction of the photosensitive drum 10 (i.e., the region of the surface of the developing roller 35 which faces the surface of the photosensitive drum 10 moves in the opposite direction to the direction of movement of the surface of the photosensitive drum 10). The downstream-side developing roller 36, which is disposed downstream in the rotational direction of the photosensitive drum 10, is driven to rotate in the opposite direction to the rotational direction of the photosensitive drum 10 (i.e., the region of the surface of the developing roller 36 which faces the surface of the photosensitive drum 10 moves in the same direction as the direction of movement of the surface of the photosensitive drum 10).

With the above-described arrangement, the developer 50 in the developing device 30, which is composed of magnetic toner and carrier, is attracted to the developing rollers 35 and 36 by magnetic force and attached to the surfaces of the sleeves 35*b* and 36*b*. Then, the developer 50 is transported to the surface of the photoconductive layer 13 of the photosensitive drum 10 by the rotation of the sleeves 35*b* and 36*b*.

A developing bias voltage of −400 V is applied to the developing rollers 35 and 36 from a developing bias voltage source 37. The bias voltage is transmitted to the carrier in the developer 50 from the sleeves 35*b* and 36*b*. It should be noted that the developing bias voltage may be set to an optimal value in the range of about −300 V to −700 V.

A blade 38 for regulating the rate of feed of the developer 50 is fixedly disposed between the two developing rollers 35 and 36 with a gap provided between the same and each of the developing rollers 35 and 36.

As a result, the flow of developer 50 which is transported from the bottom portion of the developing device 30 by the downstream-side developing roller 36 is regulated by the blade 38, and the developer 50 is then transported through the gaps between the blade 38 and the developing rollers 35 and 36. A scraper 39 scrapes the developer 50 off the upstream-side developing roller 35 and returns it to the bottom portion of the developing device 30.

In the electrophotographic apparatus, arranged as described above, charging of the photoconductive layer 13 of the photosensitive drum 10 starts at the upstream-side developing roller 35 by transmitting the developing bias voltage applied to the upstream-side developing roller 35 to the photosensitive drum 10 through the electrically conductive carrier mixed in the developer 50. At the downstream-side developing roller 36 also, charging is carried out as long as the developing bias voltage applied to the developing roller 36 is transmitted to the photosensitive drum 10 through the carrier.

Image exposure for the photosensitive drum 10 by the exposure device 20 is carried out with respect to the developing nip between the photosensitive drum 10 and the downstream-side developing roller 36. The voltage at the photoconductive layer 13 becomes close to zero (e.g., −20 V) only at the exposed portion, thereby allowing an electrostatic latent image to be formed.

While the electrostatic latent image portion of the surface of the photosensitive drum 10 is passing through the developing nip, the toner is strongly attracted to the exposed portion from the developing roller (35) side by electrostatic force. Thus, the electrostatic latent image is developed into a toner image.

At this time, the portion of the photoconductive layer 13 other than the exposed portion has been charged to a voltage close to the developing bias voltage applied to the developing roller 35, e.g., about −380 V.

Accordingly, at the non-exposed portion, the magnetic force with which the magnet roller of the developing roller 35 attracts the magnetic toner is stronger than the electrostatic force with which the photosensitive drum 10 attracts the toner. Therefore, no toner adheres to the non-exposed portion other than the latent image portion.

With the apparatus of this embodiment, charging of the photosensitive drum 10 is carried out for a relatively long time from the position of the upstream-side developing roller 35 before development and cleaning are carried out at the position of the downstream-side developing roller 36. Accordingly, the photosensitive drum 10 can be charged satisfactorily and reliably even if a medium-resistance carrier is used. Even after the electric resistance of the carrier has increased because of the use for a long time, the photosensitive drum 10 can be reliably charged.

According to our experiment, when 5,000 to 6,000 sheets of paper were printed with a conventional apparatus, the electric resistance of the carrier became high, and the charging potential dropped, resulting in "smudge" that the toner undesirably remained attached to the non-exposed portion of the photosensitive drum 10.

In contrast, with the apparatus of this embodiment, it was possible to print about 20,000 sheets of paper without causing "smudge" because it was possible to pre-charge the photosensitive drum 10 to about −300 V, for example, at the upstream-side developing roller 35, and hence possible to surely charge the photosensitive drum 10 to a predetermined voltage in the range of about −370 V to −390 V at the downstream-side developing roller 36.

Figure 3:
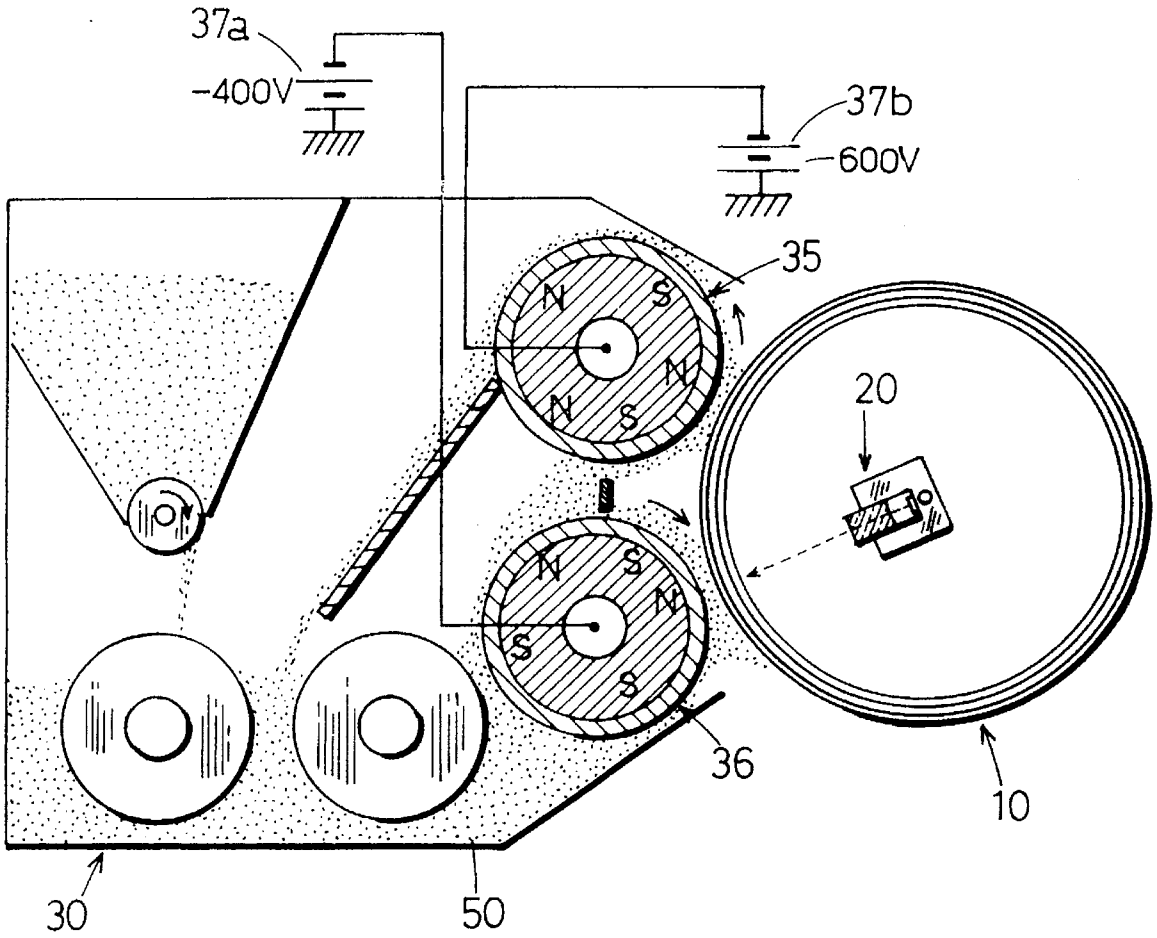
FIG. 3 is a sectional side view showing the arrangement of a second embodiment of the present invention.

FIG. 3 shows a second embodiment of the present invention, in which the developing bias voltage source is divided into a developing bias voltage source 37*a* which supplies −400 V (Vb1) to the downstream-side developing roller 36, and a developing bias voltage source 37*b* which supplies −600 V (Vb2) to the upstream-side developing roller 35. The rest of the second embodiment has the same arrangement as that of the first embodiment.

With the above-described arrangement, the surface of the photosensitive drum 10 can be charged to a level higher than the developing bias voltage (−400 V) which is applied to the downstream-side developing roller 36, that is, to a level close to −600 V.

As a result, when development is carried out at the downstream-side developing roller 36, the toner present in the non-exposed portion (as close as −600 V) of the photosensitive drum 10 can be collected by the upstream-side developing roller 35 (−400 V) even more effectively and reliably. Thus, occurrence of "smudge" can be satisfactorily prevented.

Figure 4:
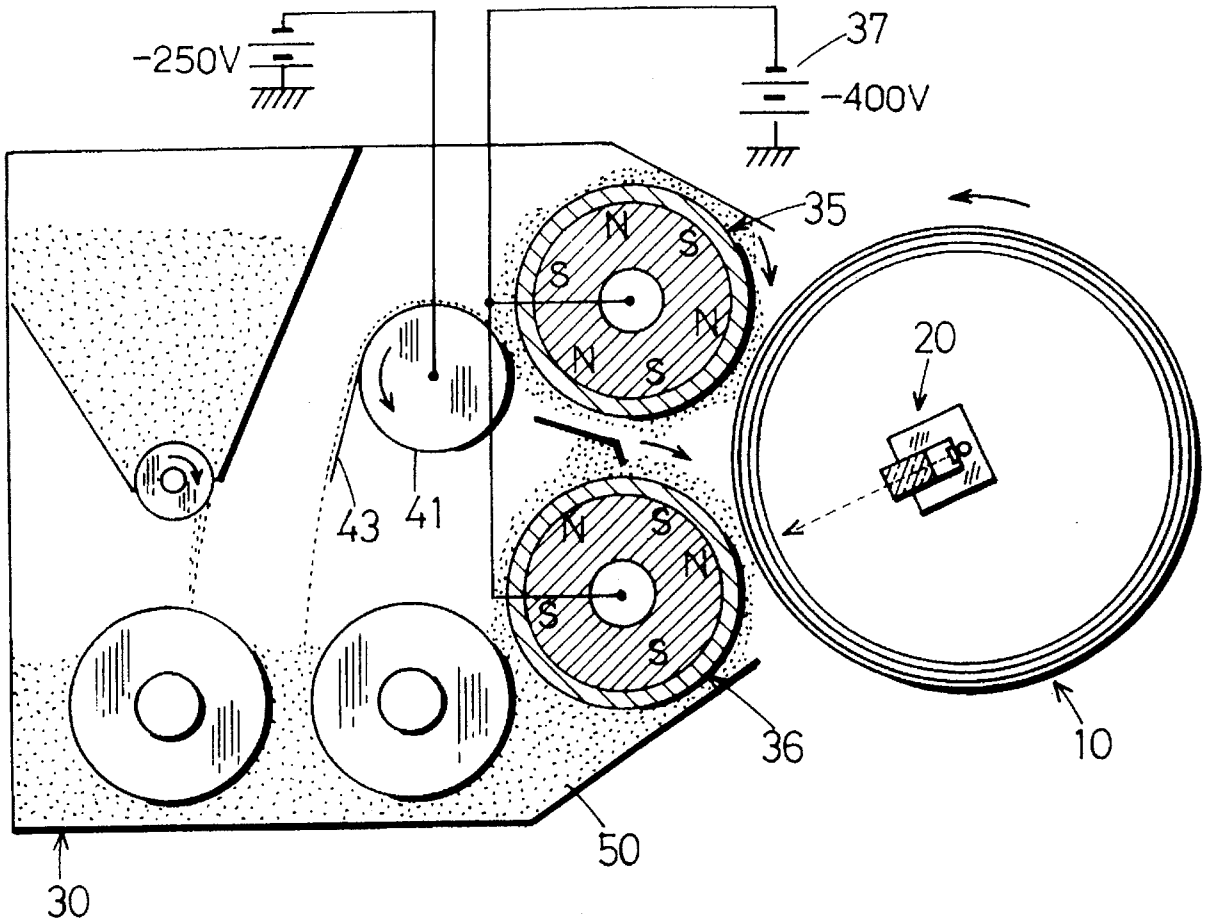
FIG. 4 is a sectional side view showing the arrangement of a third embodiment of the present invention.

FIG. 4 shows a third embodiment of the present invention, in which a toner separating roller 41 is provided for separating only the toner from the developer 50 attached to the surface of the upstream-side developing roller 35. The two developing rollers 35 and 36 are driven to rotate in the same direction so that portions of their respective surfaces which face the surface of the photosensitive drum 10 move in the same direction as the direction of movement of the surface of the photosensitive drum 10.

The toner separating roller 41 is disposed in close proximity to the upstream-side developing roller 35 and driven to rotate with a voltage of −250 V, for example, applied thereto. The bias voltage that is applied to the two developing rollers 35 and 36 is −400 V.

As a result, the toner in the developer 50 which is present on the surface of the upstream-side developing roller 35 is attracted to the toner separating roller 41 by electrostatic force. The carrier is attracted to the developing roller 35 by magnetic force. A scraper 43 scrapes the toner off the surface of the toner separating roller 41 and collects it into the developing device 30. The rest of the third embodiment has the same arrangement as that of the first embodiment.

With the above-described arrangement, the developer 50 consists of only the electrically conductive carrier in the area where the photosensitive drum 10 is charged through the upstream-side developing roller 35. Therefore, the voltage applied to the developing roller 35 is even more effectively transmitted to the photosensitive drum 10, and thus the photosensitive drum 10 can be surely charged.

Figure 5:
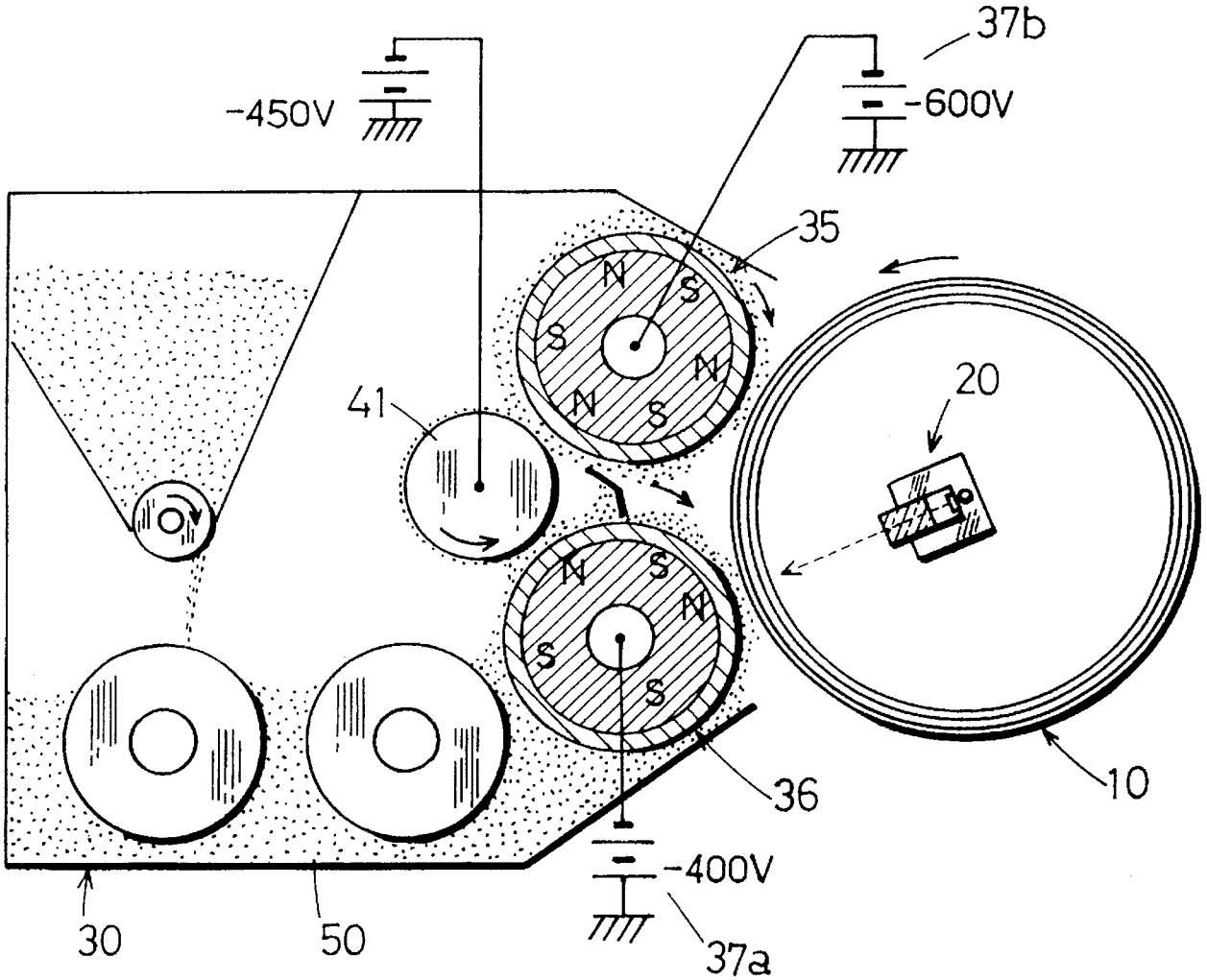
FIG. 5 is a sectional side view showing the arrangement of a fourth embodiment of the present invention.

FIG. 5 shows a fourth embodiment of the present invention, in which two developing bias voltage sources 37*a* and 37*b* are provided to supply −400 V and −600 V to the downstream- and upstream-side developing rollers 36 and 35, respectively, in the same way as in the second embodiment.

In addition, a toner separating roller 41 which is similar to that in the third embodiment is disposed in close proximity to the two developing rollers 35 and 36, and a voltage which is intermediate between the developing bias voltages applied to the two developing rollers 35 and 36, e.g., −450 V, is applied to the toner separating roller 41. The direction of rotation of the two developing rollers 35 and 36 is the same as in the third embodiment.

With the above-described arrangement, the photosensitive drum 10 can be reliably charged and cleaned by additive effects obtained by combining together the second and third embodiments. Moreover, since the toner which has shifted from the upstream-side developing roller 35 to the toner separating roller 41 shifts directly to the downstream-side developing roller 36 by the action of electrostatic force, the scraper 43 used in the third embodiment is not needed. Accordingly, it is possible to eliminate a phenomenon in which toner particles aggregate to form coarse toner when scraped.

Figure 6:
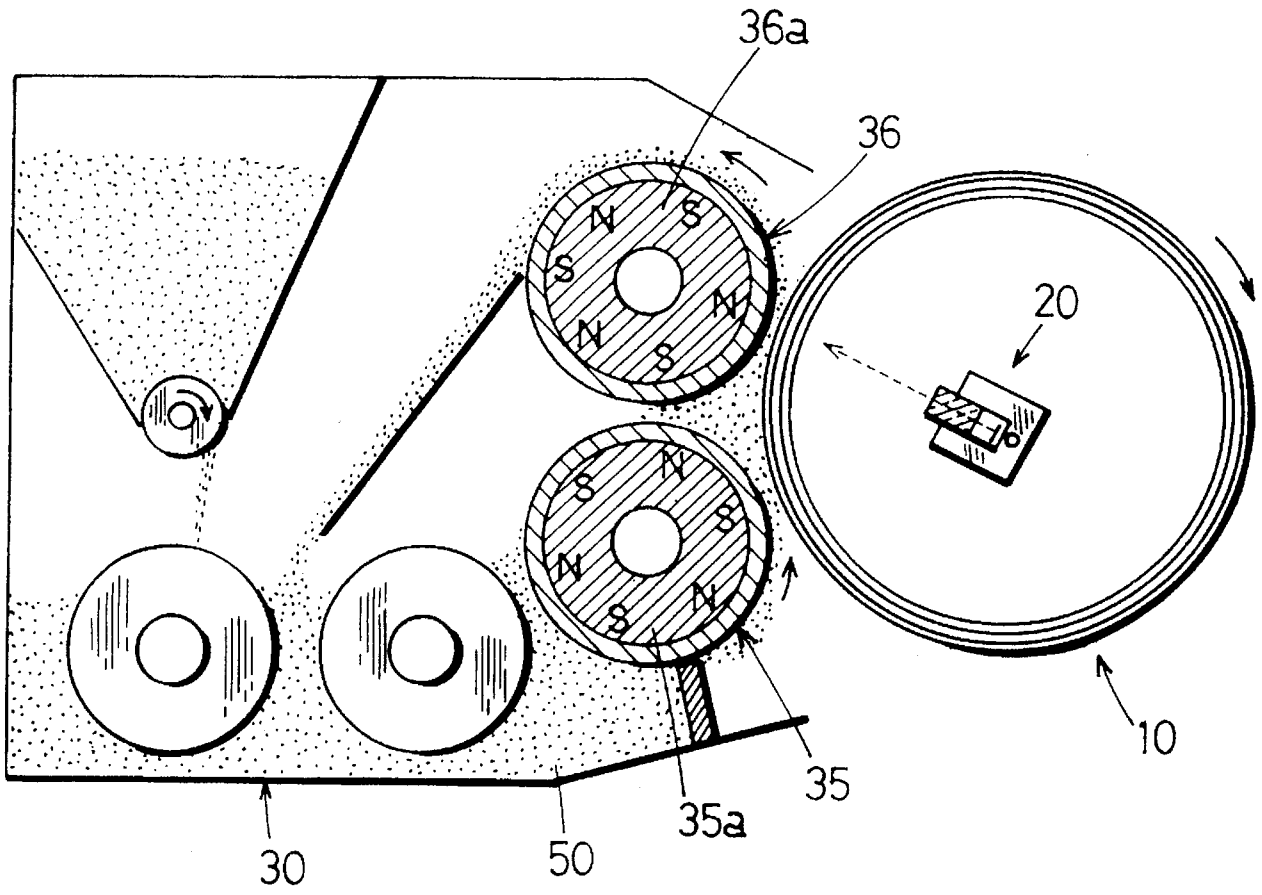
FIG. 6 is a sectional side view showing the arrangement of a fifth embodiment of the present invention.

FIG. 6 shows a fifth embodiment of the present invention, in which the upstream- and downstream-side developing rollers 35 and 36 are arrangement so that the magnetic poles of the two magnet rods 35*a* and 36*a* are opposite to each other at the position where the two developing rollers 35 and 36 face each other, thereby enabling the developer 50 to be delivered from the upstream-side developing roller 35 to the downstream-side developing roller 36. The two developing rollers 35 and 36 are driven to rotate in the same direction.

The above-described arrangement enables the developer 50 to contact the surface of the photosensitive drum 10 continuously over the area of the two developing rollers 35 and 36 and hence makes it possible to lengthen the developing nip. Accordingly, the photosensitive drum 10 can be satisfactorily and reliably charged.

It should be noted that in FIG. 6 illustration of the developing bias voltage source is omitted, and the direction of rotation of the photosensitive drum 10 and the positions of the two developing rollers 35 and 36 are shown in reverse relation to those in the other embodiments. Accordingly, the layout of the transfer roller and other constituent elements is different from that shown in FIG. 2. In FIG. 6, however, illustration of the layout is omitted.

Figure 7:
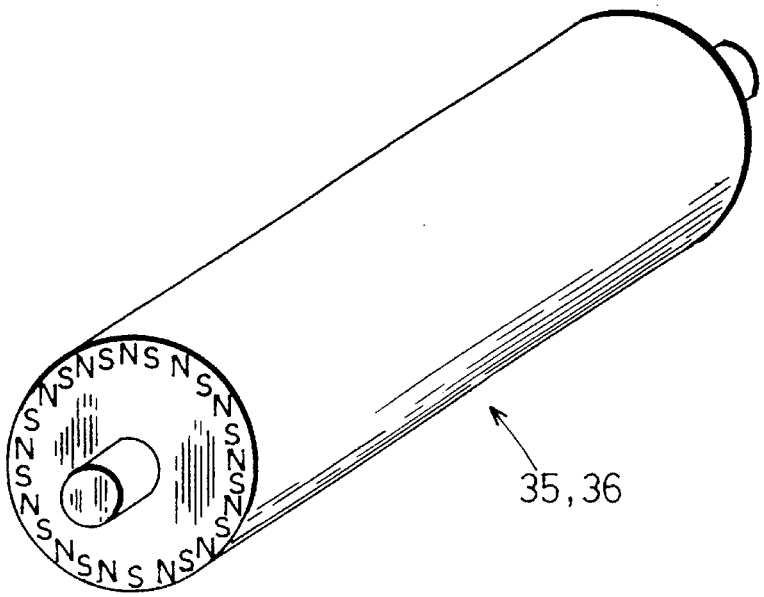
FIG. 7 is a perspective view of another example of developing rollers used in the present invention.
Figure 8:
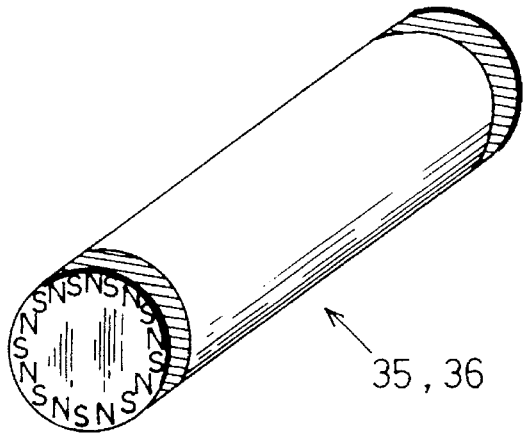
FIG. 8 is a perspective view of still another example of developing rollers used in the present invention.
Figure 9:
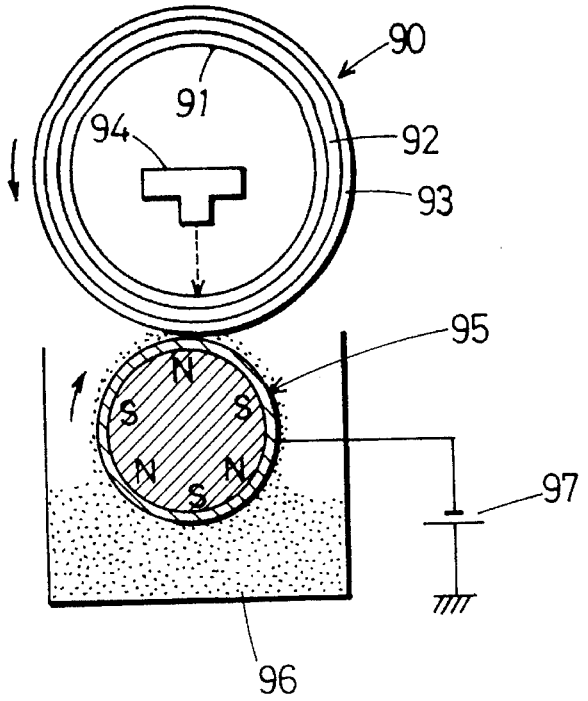
FIG. 9 is a sectional side view showing the arrangement of a conventional electrophotographic apparatus.
Figure 10:
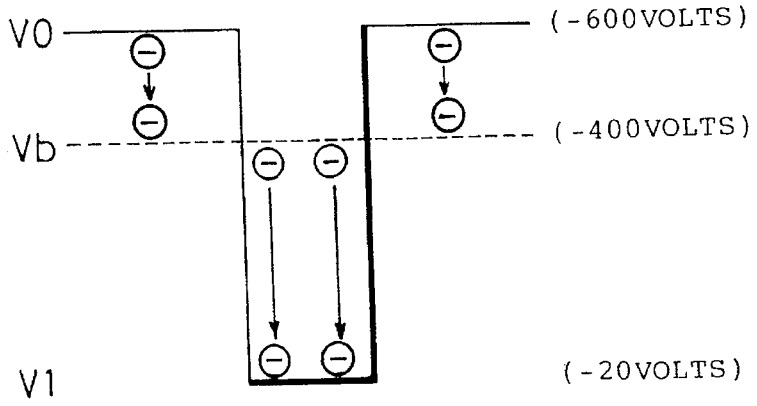
FIG. 10 is a diagram showing the developing principle of the Carlson process.
Figure 11:
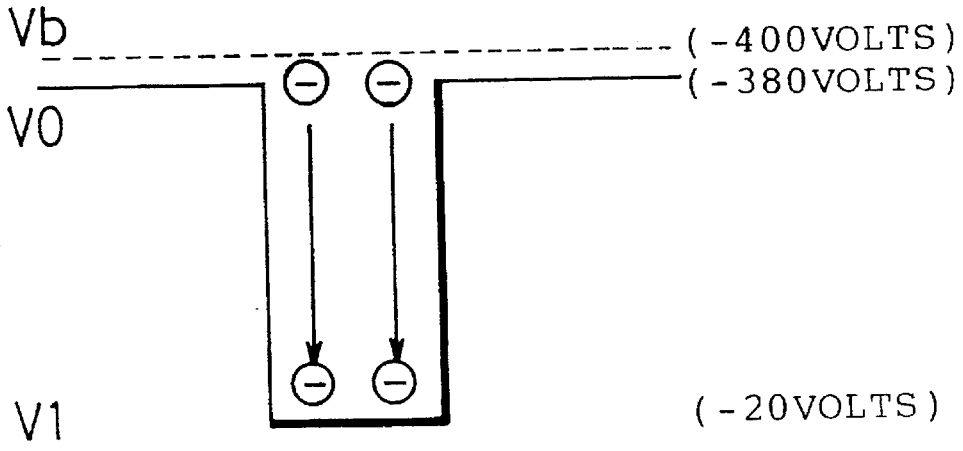
FIG. 11 is a diagram showing the developing principle of a novel electrophotographic process.

It should be noted that the present invention is not necessarily limited to the foregoing embodiments. For example, as shown in FIG. 7 or 8, each or either of the developing rollers 35 and 36 may be composed of only a magnet roller which is an electrically conductive roller having a large number of magnetic poles. In this case, the magnetic roller itself is driven to rotate.

The above-described arrangement makes it possible to simplify the developing roller arrangement and hence possible to reduce the size and cost. It should be noted that, as shown in FIG. 7, a shaft with a relatively small diameter may be provided at each end of a developing roller and supported by a bearing. Alternatively, as shown in FIG. 8, a developing roller having a uniform diameter over the entire width thereof may be supported at each end (hatched portion) by a bearing.

It is also possible to provide three or more developing rollers according to the present invention. In such a case also, exposure, development and cleaning should be carried out at the most downstream developing roller.

According to the present invention, exposure, development and cleaning for the surface of a photosensitive member are carried out at the position of a developing roller disposed most downstream in the direction of rotation of the photosensitive member. On the other hand, charging of the surface of the photosensitive member is effected by transmitting a developing bias voltage applied to a plurality of developing rollers to the photosensitive member through the carrier contained in the developer which is present in the space between the developing rollers and the photosensitive member.

Accordingly, charging of the photosensitive member starts from the position of the upstream-side developing roller, and is therefore carried out for a relatively long period of time. Thus, charging can be satisfactorily and reliably effected. Even after the electric resistance of the magnetic carrier has become high because of the use for a long time, the photosensitive member can be surely charged. As a result, occurrence of "smudge" can be prevented for a long time, and the developer can have a long lifetime.

If a medium-resistance carrier, which has an electric resistance in the range of from $10^4$ to $10^{10}$ ohm-cm, more preferably from $10^6$ to $10^8$ ohm-cm, is used, the increase in resistance due to the use is smaller than in the case of a low-resistance carrier. Accordingly, stable charging capability can be maintained. In the present invention, however, the lifetime of the developer can be increased even if a low-resistance carrier having an electric resistance of $10^3$ ohm-cm or lower is used.

Further, the photosensitive member can be charged even more reliably by arranging the system so that the developer is delivered between a plurality of developing rollers to thereby lengthen the developing nip, or by separating only the toner from the developer attached to the surface of the upstream-side developing roller so that the voltage applied to the developing roller can be even more effectively transmitted to the photosensitive member through only the carrier. Accordingly, the lifetime of the developer can be increased.

If the developing bias voltage that is applied to the most downstream developing roller is set lower than the developing bias voltage applied to the other developing rollers, the toner present in the non-exposed portion can be effectively attracted to the developing roller and thus reliably corrected. Therefore, occurrence of "smudge" can suppressed even more reliably, and the lifetime of the developer can be further increased.

While the invention has been described by reference to specific embodiments chosen for purposes of illustration, it should be apparent that numerous modifications could be made thereto by those skilled in the art without departing from the basic concept and scope of the invention.

I claim:

1. An electrophotographic apparatus comprising:

a photosensitive member having a transparent conductive layer which is optically transparent or semitransparent and of high electric conductivity, and a photoconductive layer stacked on a surface of said transparent conductive layer, said photosensitive member being driven to rotate;

a plurality of developing rollers arranged in a row in a direction of rotation of said photosensitive member so as to face a surface of said photosensitive member, said developing rollers each retaining on a surface thereof a developer consisting essentially of an electrically insulating magnetic toner and an electrically conductive magnetic carrier, at least a surface portion of each developing roller being driven to rotate in order to transport said developer to a surface of said photoconductive layer of said photosensitive member;

means for applying a developing bias voltage to each of said developing rollers; and means for exposing said photosensitive member by applying image light from a reverse side of said photosensitive member toward one of said developing rollers which is disposed most downstream in the direction of rotation of said photosensitive member.

2. An electrophotographic apparatus according to claim 1, wherein said photosensitive member has a cylindrical shape, said developing rollers being disposed on the same circumference which is centered at a central axis of said photosensitive member.

3. An electrophotographic apparatus according to claim 1, wherein said magnetic carrier has an electric resistance in the range of from $10^4$ to $10^{10}$ ohm-cm.

4. An electrophotographic apparatus according to claim 1, wherein said magnetic carrier has an electric resistance in the range of from $10^6$ to $10^8$ ohm-cm.

5. An electrophotographic apparatus according to claim 1, wherein at least one of said developing rollers includes a fixed magnet roller having a plurality of magnetic poles, and an electrically conductive sleeve which is driven to rotate around said fixed magnet roller.

6. An electrophotographic apparatus according to claim 1, wherein said developing rollers are magnet rollers which have electric conductivity and a multiplicity of magnetic poles and are driven to rotate.

7. An electrophotographic apparatus according to claim 1, wherein said developing rollers are magnetized so that said developer is delivered between said developing rollers.

8. An electrophotographic apparatus according to claim 1, which satisfies the following condition:

$$|Vb1|<|Vb2|$$

where Vb1 is a developing bias voltage applied to the developing roller disposed most downstream in the direction of rotation of said photosensitive member from said developing bias voltage applying means, and Vb2 is a developing bias voltage applied to the other developing roller.

9. An electrophotographic apparatus according to claim 1, further comprising means for separating only the toner from the developer attached to the surface of the developing roller other than said most downstream developing roller.

10. An electrophotographic apparatus according to claim 9, wherein the toner that is separated by said toner separating means is delivered directly to said most downstream developing roller from said toner separating means.

* * * * *